US009027377B2

(12) United States Patent
Yamane

(10) Patent No.: US 9,027,377 B2
(45) Date of Patent: May 12, 2015

(54) ROLLING STAND

(75) Inventor: Akihito Yamane, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 1160 days.

(21) Appl. No.: 12/448,858

(22) PCT Filed: Dec. 17, 2007

(86) PCT No.: PCT/JP2007/074199

§ 371 (c)(1),
(2), (4) Date: Mar. 29, 2010

(87) PCT Pub. No.: WO2008/084630

PCT Pub. Date: Jul. 17, 2008

(65) Prior Publication Data

US 2010/0192657 A1 Aug. 5, 2010

(30) Foreign Application Priority Data

Jan. 11, 2007 (JP) ..... 2007-003053
May 31, 2007 (JP) ..... 2007-144648

(51) Int. Cl.
*B21B 13/10* (2006.01)
*B21B 27/02* (2006.01)

(52) U.S. Cl.
CPC ..... *B21B 13/10* (2013.01); *B21B 27/024* (2013.01)

(58) Field of Classification Search
CPC ..... B21B 13/10; B21B 27/024
USPC ..... 72/224, 225, 23, 252.5, 234, 467, 399, 72/402, 235, 95, 98, 100, 11, 367.1, 368, 72/370.14, 370.24
See application file for complete search history.

(56) References Cited

U.S. PATENT DOCUMENTS

| | | | | | |
|---|---|---|---|---|---|
| 1,623,273 | A * | 4/1927 | Rendleman | ..... | 72/235 |
| 2,191,391 | A * | 2/1940 | Hooper | ..... | 72/224 |
| 6,047,578 | A * | 4/2000 | Thieven | ..... | 72/11.6 |
| 6,276,182 | B1 * | 8/2001 | Cernuschi et al. | ..... | 72/224 |
| 6,442,989 | B1 * | 9/2002 | Takeda et al. | ..... | 72/224 |
| 6,546,777 | B2 * | 4/2003 | Shore et al. | ..... | 72/235 |

FOREIGN PATENT DOCUMENTS

| | | |
|---|---|---|
| JP | 1-266904 | 10/1989 |
| JP | 2-104403 | 4/1990 |
| JP | 11-47809 | 2/1999 |
| JP | 2005-131706 | 5/2005 |
| JP | 2003-220403 | 8/2005 |

* cited by examiner

*Primary Examiner* — Shelley Self
*Assistant Examiner* — Matthew G Katcoff
(74) *Attorney, Agent, or Firm* — Clark & Brody

(57) ABSTRACT

A rolling stand 100 in accordance with the invention is a rolling stand provided with three grooved rolls for rolling a tubular or bar shaped material to be rolled, in which three grooved rolls R21 to R23 are arranged in such a manner that an angle formed by pressing directions of any two adjacent grooved rolls of the three grooved rolls R21 to R23 comes to 120 degrees. With regard to a cross sectional shape of each of the grooved rolls R21 to R23 formed by cutting each of the grooved rolls in a plane which includes a center line of a rotating axis of each of the grooved rolls R21 to R23 and is orthogonal to a pass line of a material to be rolled, any one grooved roll R21 is provided with a first straight portion L1 extending vertically to the pressing direction in both side flange portions, and the other two grooved rolls R22 and R23 are provided with a second straight portion L2 opposing to the first straight portion L1 and extending in parallel to the first straight portion L1 in the flange portions.

3 Claims, 6 Drawing Sheets

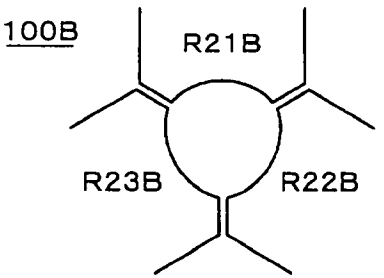
Fig.5A
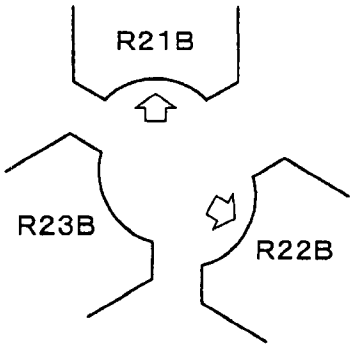
Fig.5B
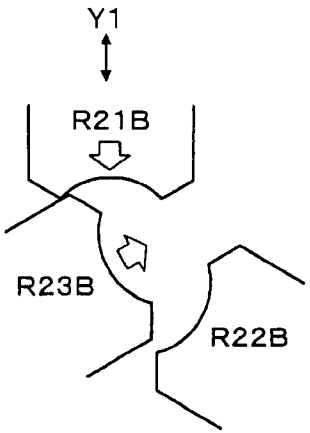
Fig.5C
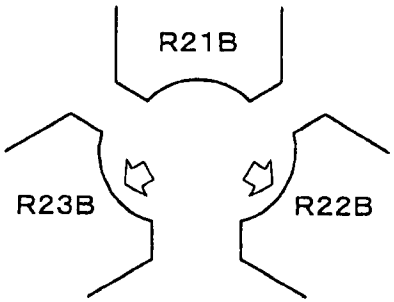
Fig.5D
Fig.5E
Fig.5F
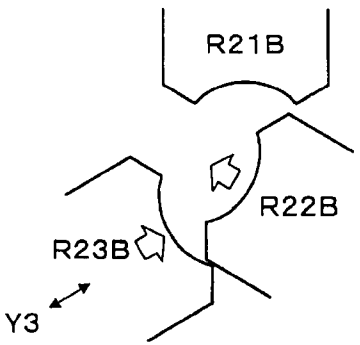
Fig.5G
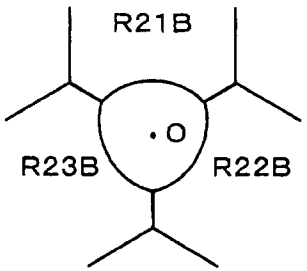
Fig.5H

ROLLING STAND

TECHNICAL FIELD

The present invention relates to a rolling stand for rolling a tubular or bar-shaped material to be rolled such as a seamless pipe or tube (hereinafter, "pipe or tube" is referred as pipe when deemed appropriate), a steel bar or the like. More particularly, the present invention relates to a rolling stand in which a relative reference position for regulating a pressing position of a grooved roll arranged in the rolling stand can be easily decided, and a calibration of the pressing position can be easily carried out.

BACKGROUND ART

In manufacturing of a seamless pipe in accordance with a Mannesmann mandrel mill method, a hollow shell is manufactured by first of all heating a round billet or a rectangular billet by a heating furnace, and thereafter piercing and rolling by a piecer. Next, a mandrel bar is inserted to an inner surface of the hollow shell and is drawn and rolled by a mandrel mill constructed by a plurality of rolling stands. Thereafter, a product is obtained by forming and rolling the pipe material to a predetermined outer diameter by a sizing mill.

Conventionally, as shown in FIG. 1A, there has been used a 2-roll type mandrel mill in which two opposing grooved rolls R11' and R12' are arranged in each of rolling stands, and are alternately arranged in such a manner as to shift pressing directions of the grooved rolls R11' and R12' at 90 degrees between the adjacent rolling stands. Further, as shown in FIG. 1B, there has been used a 3-roll type mandrel mill in which three grooved rolls R21', R22' and R23' are arranged in each of the rolling stands in such a manner that an angle formed by pressing directions of any two adjacent grooved rolls of the three grooved rolls R21', R22' and R23' comes to 120 degrees, and are alternately arranged in such a manner as to shift pressing directions of the grooved rolls R21', R22' and R23' at 60 degrees between the adjacent rolling stands. Further, as shown in FIG. 1C, there has been applied a 4-roll type mandrel mill in which four grooved rolls R31', R32', R33' and R34' are arranged in each of the rolling stands in such a manner that an angle formed by pressing directions of any two adjacent grooved rolls of the four grooved rolls R31', R32', R33' and R34' comes to 90 degrees.

In this case, in order to secure a thickness precision of the material to be rolled in the mandrel mill, and suppress a thickness deviation, it is important to set a pressing position of each of the grooved rolls (position of each of the grooved rolls with respect to the material to be rolled at a time of rolling the material to be rolled) provided in each of the rolling stands of the mandrel mill to a proper position. Specifically, as shown in FIGS. 1A to 1C, it is important that a groove bottom B of each of the grooved rolls comes to a position which comes away evenly at a desired amount from a center O of a pass line of the material to be rolled. However, due to a dimensional tolerance, an installation error and the like of each of the grooved rolls and a tool holding the grooved roll, it is actually hard to set the pressing position of each of the grooved rolls in accordance with a design value.

Accordingly, in the 2-roll type mandrel mill, there is used a method of moving the opposing grooved rolls R11' and R12' in the pressing direction (direction of an arrow in FIG. 1A), bringing flange portions F' into contact with each other so as to press to each other at certain load, and regulating the pressing position in the pressing direction by setting the positions of the respective grooved rolls R11' and R12' at this time to reference positions in the pressing direction. Specifically, after the reference position of each of the grooved rolls R11' and R12' is decided, the position of each of the grooved rolls R11' and R12' is evenly moved in the pressing direction from the reference position.

However, in the case of the 3-roll type or 4-roll type mandrel mill, since a degree of freedom of a relative position between the positions of the respective grooved rolls is great, it is not possible to suitably decide the reference position in the pressing direction of the grooved roll by the method in the case of the 2-roll type mandrel mill mentioned above. Accordingly, since it is not possible to regulate the pressing position of each of the grooved rolls to the proper position, there is a problem that it is hard to suppress the thickness deviation of the material to be rolled.

In Japanese Unexamined Patent Publication No. 2005-131706, there has been proposed a method of arranging a thickness measuring apparatus in an outlet side of the mandrel and regulating the pressing position in the pressing direction of each of the grooved rolls based on a thickness measured value of the material to be rolled measured by the thickness measuring apparatus, in the 3-roll type mandrel mill. However, since a measured value by the thickness measuring apparatus does not exists, with regard to the material to be rolled which is first rolled, it is not possible to regulate the pressing position of each of the grooved rolls to a proper position, at least with regard to the first material to be rolled, and it is hard to suppress the thickness deviation.

On the other hand, even in the 2-roll type mandrel mill, there is a case that positions of the grooved rolls R11' and R12' in a direction (direction shown by an arrow in FIG. 2) which is vertical to the pressing direction of the grooved rolls R11' and R12' are shifted, as shown in FIG. 2, due to the dimensional tolerance, the installation error and the like of each of the grooved rolls and the tool holding the grooved roll. If the displacement in the direction which is vertical to the pressing direction is generated, the thickness deviation is generated in the material to be rolled P. However, the displacement cannot be set right by the method of moving the grooved rolls R11' and R12' in the pressing direction so as to bring the flange portions into contact with each other.

In Japanese Unexamined Patent Publication No. 2003-220403, there has been proposed a method of individually regulating a closing amount in each of the flange sides of the grooved rolls provided in the mandrel mill, based on a thickness measured value of the material to be rolled measured in a downstream side of the mandrel mill. In accordance with the method described in Japanese Unexamined Patent Publication No. 2003-220403, it is possible to regulate the pressing position of the grooved roll even in a direction which is vertical to the pressing direction, by differentiating the closing amount in each of the flange sides. However, since the thickness measured value does not exist with regard to the material to be rolled which is first rolled, it is not possible to regulate the pressing position in the direction which is vertical to the pressing direction of each of the grooved rolls to the proper position, with regard to at least the first material to be rolled, and it is hard to suppress the thickness deviation as shown in FIG. 2. This is the same in the case of the 3-roll type and 4-roll type mandrel mills.

The problem of the prior art mentioned above is not limited to the mandrel mill, but is in common to the rolling stand rolling the material to be rolled by using the grooved roll.

DISCLOSURE OF THE INVENTION

The present invention has been devised to solve the problem of the prior art mentioned above, and an object of the present invention is to provide a rolling stand for rolling a tubular or bar-shaped material to be rolled such as a seamless pipe, a steel bar or the like, wherein a reference position for regulating a pressing position of a grooved roll arranged in the rolling stand can be easily decided, and a calibration of the pressing position can be easily carried out.

A first aspect in accordance with the present invention provides a rolling stand in which three grooved rolls are arranged, wherein a reference position in a pressing direction of the grooved roll can be easily decided, and a calibration of a pressing position can be easily carried out.

In other words, the first aspect in accordance with the present invention provides the rolling stand in which a cross sectional shape of each of the grooved rolls formed by cutting each of the grooved rolls in a plane which includes a center line of a rotating axis of each of the grooved rolls and is orthogonal to a pass line of a material to be rolled is provided with the following features, in the three grooved rolls arranged in such a manner that an angle formed by pressing directions of any two adjacent grooved rolls of the three grooved rolls comes to 120 degrees.

(1) the cross sectional shape of any one grooved roll of the three grooved rolls is provided with a first straight portion extending vertically to the pressing direction in both side flange portions.

(2) the cross sectional shape of the other two grooved rolls is provided with a second straight portion opposing to the first straight portion and extending in parallel to the first straight portion in the flange portions.

In the first aspect mentioned above, in order to easily decide the reference position in the direction which is vertical to the pressing direction in addition to the pressing direction of the grooved roll, it is preferable to structure the rolling stand which is further provided with the following feature.

(1) the cross sectional shape of the any one grooved roll provided with the first straight portion is further provided with a third straight portion extending in parallel to the pressing direction in at least one side flange portion.

(2) the cross sectional shape of at least one grooved roll of the other two grooved rolls provided with the second straight portions is further provided with a fourth straight portion opposing to the third straight portion and extending in parallel to the third straight portion in the flange portion.

A second aspect in accordance with the present invention provides a rolling stand in which three grooved rolls are arranged, wherein a reference position in a pressing direction of the grooved roll can be easily decided, and a calibration of pressing position can be easily carried out.

In other words, the second aspect in accordance with the present invention provides the rolling stand in which three grooved rolls are arranged in such a manner that an angle formed by the pressing directions of any two adjacent grooved rolls of the three grooved rolls comes to 120 degrees, and at least any two grooved rolls can further close in the pressing direction (move in such a manner as to come close to a center of a pass line of a material to be rolled) in comparison with a positions at which both side flange portions of three grooved rolls come into contact with each other.

A third aspect in accordance with the present invention provides a rolling stand in which two grooved rolls are arranged, wherein a reference position in a pressing direction and a direction which is vertical to the pressing direction of the grooved roll can be easily decided, and a calibration of a pressing position can be easily carried out.

In other words, the third aspect in accordance with the present invention provides the rolling stand in which a cross sectional shape of each of the grooved rolls formed by cutting each of the grooved rolls in a plane which includes a center line of a rotating axis of each of the grooved rolls and is orthogonal to a pass line of a material to be rolled is provided with the following features, in the opposing two grooved rolls.

(1) the cross sectional shape of one grooved roll is provided with a third straight portion extending in parallel to the pressing direction in at least one side flange portion.

(2) the cross sectional shape of the other grooved roll is provided with a fourth straight portion opposing to the third straight portion and extending in parallel to the third straight portion in the flange portion.

A fourth aspect in accordance with the present invention provides a rolling stand in which four grooved rolls are arranged, wherein a reference position in a pressing direction and a direction which is vertical to the pressing direction of the grooved roll can be easily decide, and a calibration of a pressing position can be easily carried out.

In other words, the fourth aspect in accordance with the present invention provides the rolling stand in which a cross sectional shape of each of the grooved rolls formed by cutting each of the grooved rolls in a plane which includes a center line of a rotating axis of each of the grooved rolls and is orthogonal to a pass line of a material to be rolled is provided with the following features, in four grooved rolls arranged in such a manner that an angle formed by pressing directions of any two adjacent grooved rolls of the four grooved rolls comes to 90 degrees.

(1) the cross sectional shape of at least one grooved roll in any one set of opposing grooved rolls is provided with a first straight portion extending vertically to the pressing direction in both side flange portions, and is provided with a third straight portion extending in parallel to the pressing direction in both side flange portions.

(2) the cross sectional shape of each of the grooved rolls in the other set of grooved rolls is provided with a second straight portion opposing to the first straight portion and extending in parallel to the first straight portion in a flange portion, and is provided with a fourth straight portion opposing to the third straight portion and extending in parallel to the third straight portion in the flange portion.

In accordance with the present invention, since it is possible to easily decide the reference position for regulating the pressing position of the grooved roll arranged in the rolling stand, it is possible to regulate the pressing position of each of the grooved rolls to a proper position. For example, in the case that the material to be rolled is formed in the tubular shape, it is possible to suppress the thickness deviation.

BRIEF DESCRIPTION OF THE DRAWINGS

FIGS. 5A to 5H are vertical cross sectional views showing an outline structure of a rolling stand constructing a 3-roll type mandrel mill in accordance with a second embodiment of the present invention and an example of a deciding procedure of a reference position for regulating a pressing position.

BEST MODE FOR CARRYING OUT THE INVENTION

A description will be given below of an embodiment in accordance with the present invention appropriately with reference to the accompanying drawings.

First Embodiment

FIGS. 3A to 3G are vertical cross sectional views showing an outline structure of a rolling stand constructing a 3-roll type mandrel mill in accordance with a first embodiment of the present invention and an example of a deciding procedure of a reference position for regulating a pressing position. As shown in FIGS. 3A to 3G, a rolling stand 100 in accordance with the present embodiment is provided with a housing (not shown), and three grooved rolls R21, R22 and R23 arranged in the housing in such a manner that an angle formed by pressing directions of any two adjacent grooved rolls of the three grooved rolls R21, R22 and R23 comes to 120 degrees.

The following feature is provided in a vertical cross sectional shape of the grooved rolls R21, R22 and R23 (the vertical cross sectional shape obtained by cutting in a plane which includes center lines of rotating axes of the grooved rolls R21, R22 and R23 and is orthogonal to a pass line (reference symbol O in FIG. 3G denotes a pass line center of a material to be rolled) of the material to be rolled) provided in the rolling stand 100 in accordance with the present embodiment. In other words, any one grooved roll R21 is provided with a first straight portion L1 extending vertically to a pressing direction (Y direction in FIG. 3A) in both side flange portions. Further, the other two grooved rolls R22 and R23 are provided with a second straight portion L2 opposing to the first straight portion L1 and extending in parallel to the first straight portion L1 in a flange portion.

In the rolling stand 100 having the structure mentioned above, the decision of the reference position in the Y direction for regulating the pressing positions of the grooved rolls R21, R22 and R23 is carried out, for example, in accordance with the following procedure.

Figures 3A, 3B, 3C, 3D, 3E, 3F, 3G:
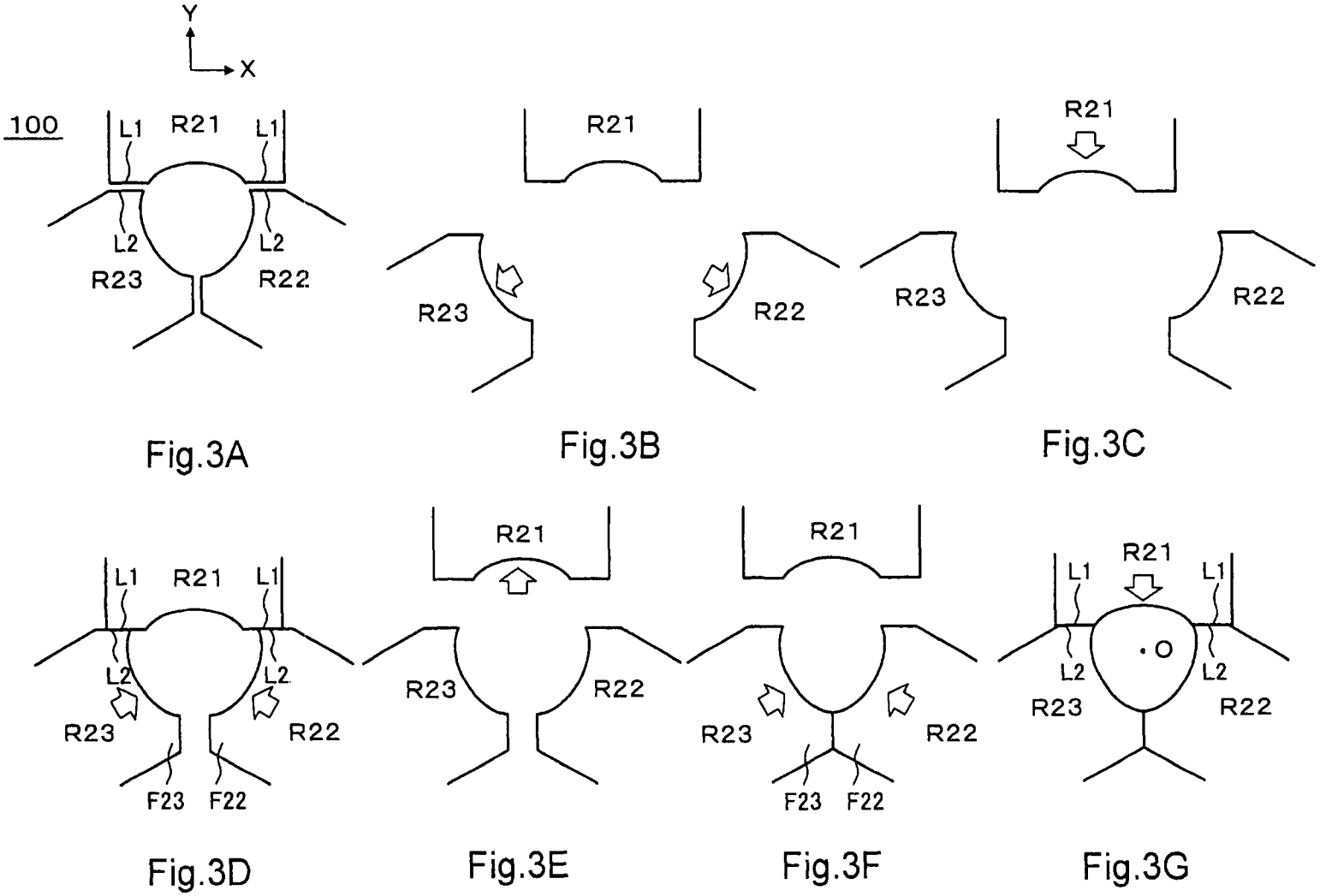
FIGS. 3A to 3G are vertical cross sectional views showing an outline structure of a rolling stand constructing a 3-roll type mandrel mill in accordance with a first embodiment of the present invention and an example of a deciding procedure of a reference position for regulating a pressing position.

First, in the grooved rolls R21 to R23 in an initial state (state shown in FIG. 3A), each of the grooved rolls R22 and R23 provided with the second straight portion L2 is opened in the pressing direction (is moved in a direction which comes away from the center O of the pass line), as shown in FIG. 3B. Next, the grooved roll R21 is closed in the pressing direction (is moved so as to come close to the center O of the pass line), as shown in FIG. 3C. With the operation mentioned above, it is possible to prevent a flange portion F22 of the grooved roll R22 and a flange portion F23 of the grooved roll R23 from coming into contact with each other at a time of bringing the straight portion L1 into contact with the straight portion L2 as mentioned below.

Next, as shown in FIG. 3D, each of the grooved rolls R22 and R23 is closed in the pressing direction until the second straight portion L2 of the grooved rolls R22 and R23 comes into contact with the first straight portion L1 of the grooved roll R21 under certain load. At this time, since the flange portion F22 in a side in which the straight portion L2 of the grooved roll R22 is not provided does not come into contact with the flange portion F23 in a side in which the straight portion L2 of the grooved roll R23 is not provided, the contact between the first straight portion L1 and the second straight portion L2 is not obstructed.

Next, after the grooved roll R21 provided with the first straight portion L1 is opened in the pressing direction as shown in FIG. 3E, the grooved rolls R22 and R23 provided with the second straight portion L2 are closed evenly in the pressing direction until the flange portions F22 and F23 thereof come into contact with each other under certain load as shown in FIG. 3F.

Finally, the grooved roll R21 is closed in the pressing direction until the first straight portion L1 of the grooved roll R21 comes into contact with the second straight portion L2 of the grooved rolls R22 and R23 under certain load, as shown in FIG. 3G.

In accordance with the procedure described above, it is possible to decide at least the reference position in the Y direction of the grooved rolls R21 to R23. Further, in each of the grooved rolls R21 to R23, it is possible to carry out the calibration of the pressing position based on the information of the reference position (the position shown in FIG. 3G), and to suppress a thickness deviation of the material to be rolled. In this case, if the grooved rolls R21 to R23 are integrally moved by moving the housing in such a manner that a position of center of gravity of the grooved rolls R21 to R23 existing at the reference position comes into line with the center O of the pass line, the calibration of the pressing position can be achieved based on the center O of the pass line.

Figure 4:
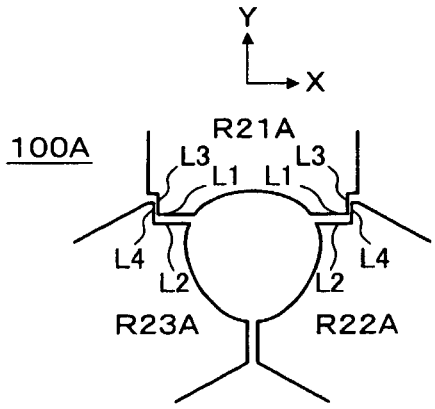
FIG. 4 is a vertical cross sectional view showing an outline structure of a rolling stand constructing a 3-roll type mandrel mill in accordance with a modified embodiment of the first embodiment of the present invention.

In this case, in the rolling stand in accordance with the present embodiment described above, in order to easily decide a reference position in a direction which is vertical to the pressing direction in addition to the pressing direction of the grooved roll, it is preferable to employ a rolling stand 100A as shown in FIG. 4. A description will be given below mainly of a different point from the rolling stand 100 mentioned above, in the rolling stand 100A shown in FIG. 4.

FIG. 4 is a vertical cross sectional view showing an outline structure of a rolling stand constructing a 3-roll type mandrel mill in accordance with a modified embodiment of the first embodiment of the present invention. As shown in FIG. 4, a vertical cross sectional shape of grooved rolls R21A, R22A and R23A provided in the rolling stand 100A in accordance with the present embodiment has the following feature in addition to the feature of the grooved rolls R21, R22 and R23 mentioned above. In other words, any one grooved roll R21A is further provided with a third straight portion L3 extending in parallel to a pressing direction (Y direction in FIG. 4) in at least one side flange portion (both side flange portions in the embodiment shown in FIG. 4). Further, at least one grooved roll (both the grooved rolls in the embodiment shown in FIG. 4) of the other two grooved rolls R22A and R23A is provided with a fourth straight portion L4 opposing to the third straight portion L3 and extending in parallel to the third straight portion L3 in the flange portion. In this case, a point that the grooved roll R21A is provided with the first straight portion L1 extending vertically to the pressing direction in the both side flange portions is the same as the grooved roll R21 mentioned above. Further, a point that the grooved rolls R22A and R23A is provided with the second straight portion L2 opposing to the first straight portion L1 and extending in parallel to the first straight portion L1 in the flange portion is the same as the grooved rolls R22 and R23 mentioned above.

In the rolling stand 100A having the structure mentioned above, the decision of the reference position in the Y direction for regulating the pressing position of the grooved rolls R21A, R22A and R23A is carried out, for example, in accordance with the same procedure as the rolling stand 100 mentioned above with reference to FIGS. 3A to 3G.

On the other hand, the decision of the reference position in the direction (X direction in FIG. 4) which is vertical to the pressing direction is carried out, for example, by deciding the reference position in the Y direction, and thereafter moving the grooved roll R21A in the X direction until the third straight portion L3 of the grooved roll R21A comes into contact with the fourth straight portion L4 of the grooved roll R22A or R23A under certain load, from the state shown in FIG. 4. In the modified embodiment shown in FIG. 4, since the third straight portion L3 is provided in both side flange portions of the grooved roll R21A, the reference position in the X direction of the grooved roll R21A can be decided by bringing any one third straight portion L3 into contact with the fourth straight portion L4 opposing thereto, or by making an interval of the third straight portions L3 approximately equal to an interval of the fourth straight portions L4, and fitting the third straight portion L3 between the fourth straight portions L4. In this case, the decision of the reference position in the X direction of the grooved roll R21A can be achieved by attaching a driving mechanism (cylinder apparatus or the like) moving forward and backward in the X direction to the grooved roll R21A, however, can be achieved by attaching the driving mechanisms moving forward and backward in the Y direction to both sides in the direction of the rotating axis of the grooved roll R21A and differentiating the amount of forward and backward movement of both the driving mechanisms in the same manner as the technique described in Japanese Unexamined Patent Publication No. 2003-220403 (in the latter case, the grooved roll R21A can move in the X direction at the same time of the Y direction, however, if the directions of the forward and backward movement of both the driving mechanisms are reversed and their absolute values are set to the same amount, it is possible to move only in the X direction).

With the procedure described above, in accordance with the rolling stand 100A of the present embodiment, it is also possible to decide the reference position in the X direction in addition to the Y direction of the grooved rolls R21A to R23A. Further, in each of the grooved rolls R21A to R23A, it is possible to carry out the calibration of the pressing position based on the information of the reference position, and further to suppress the thickness deviation of the material to be rolled.

Second Embodiment

FIG. 5A to 5H are vertical cross sectional views showing an outline structure of a rolling stand constructing a 3-roll type mandrel mill in accordance with a second embodiment of the present invention and an example of a deciding procedure of a reference position for regulating a pressing position. As shown in FIG. 5A to 5H, a rolling stand 100B in accordance with the present embodiment is provided with a housing (not shown), and three grooved rolls R21B, R22B and R23B arranged in the housing in such a manner that an angle formed by pressing directions of any two adjacent grooved rolls of the three grooved rolls R21, R22 and R23 comes to 120 degrees.

Figure 1A:
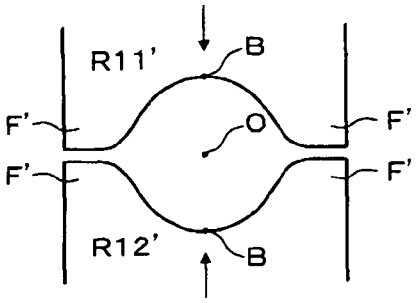
FIG. 1A is a vertical cross sectional view schematically showing an example of a rolling stand comprising two grooved rolls and constructing a mandrel mill.
Figure 1B:
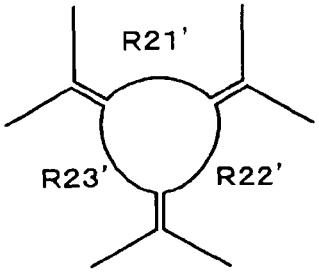
FIG. 1B is a vertical cross sectional view schematically showing an example of a rolling stand comprising three grooved rolls and constructing a mandrel mill.
Figure 1C:
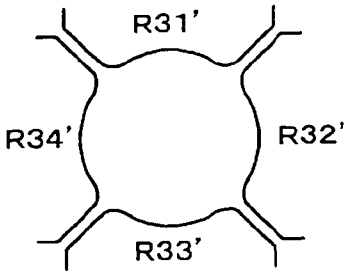
FIG. 1C is a vertical cross sectional view schematically showing an example of a rolling stand comprising four grooved rolls and constructing a mandrel mill.
Figure 2:
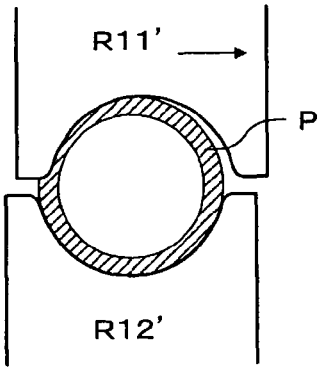
FIG. 2 is a vertical cross sectional view explaining a displacement in a horizontal direction of a grooved roll constructing the rolling stand.

Unlike the first embodiment, it is not necessary that a novel feature is provided in a vertical cross sectional shape of grooved rolls R21B, R22B and R23B (cross sectional shape formed by cutting in a plane which includes center lines of rotating axes of the grooved rolls R21B, R22B and R23B and is orthogonal to a pass line (reference symbol O in FIG. 5H denotes a center of the pass line of the material to be rolled) of the material to be rolled) provided in the rolling stand 100B in accordance with the present embodiment, but the same shape as the conventional one (see FIG. 1B) can be employed. In this case, the rolling stand 100B in accordance with the present embodiment has a feature in that at least any two (three in the present embodiment) grooved rolls R21B, R22B and R23B can close in the more pressing direction (move in such a manner as to come close to the center O of the pass line of the material to be rolled) than a position (position shown in FIG. 5H) at which both side flange portions of three grooved rolls R21B, R22B and R23B come into contact with each other. This structure can be achieved, for example, by extending a stroke of a driving mechanism (cylinder apparatus or the like) which is attached to each of the grooved rolls R21B, R22B and R23B and moving forward and backward each of the grooved rolls R21B, R22B and R23B in the pressing direction, in a direction coming close to the center O of the pass line of the material to be rolled in comparison with the state shown in FIG. 5H.

In the rolling stand 100B having the structure mentioned above, the reference position in the pressing direction of each of the grooved rolls is decided for regulating the pressing position of the grooved rolls R21B, R22B and R23B, for example, in accordance with the following procedure.

In order to decide the reference position in the pressing direction of the grooved roll R21B, each of the grooved rolls R21B and R22B is first opened in the pressing direction (is moved in a direction coming away from the center O of the pass line), as shown in FIG. 5B, in the grooved rolls R21B to R23B in an initial state (state shown in FIG. 5A). At this time, the grooved roll R21B is opened to a position at which the flange portion of the grooved roll R23B does not come into contact with the flange portion of the grooved roll R21B, at a time of closing the grooved roll R23B in the pressing direction (coming to a state shown in FIG. 5C) as mentioned below. Further, the grooved roll R22B is opened to a position at which the grooved roll R23B does not interfere with the grooved roll R22B, at a time of closing the grooved roll R23B in the pressing direction (coming to a state shown in FIG. 5C) as mentioned below.

Next, as shown in FIG. 5C, after the grooved roll R23B is closed more in the pressing direction than a position shown in FIG. 5H (is moved in such a manner as to come close to the center O of the pass line), the grooved roll R21B is closed in the pressing direction until the flange portion of the grooved roll R21B comes into contact with the side surface of the grooved roll R23B under certain load. At this time, since the side surface of the grooved roll R23B extends in parallel to the pressing direction of the grooved roll R23B, a position at which the flange portion of the grooved roll R21B comes into contact with the side surface of the grooved roll R23B (position in the pressing direction (Y1 direction in FIG. 5C) of the grooved roll R21B) is fixed regardless of a closing amount of the grooved roll R23B (moving amount from a position shown in FIG. 5H). Accordingly, it is possible to decide the reference position in the pressing direction of the grooved roll R21B in accordance with the procedure mentioned above.

Next, in order to decide the reference position in the pressing direction of the grooved roll R22B, each of the grooved rolls R22B and R23B is opened in the pressing direction (is moved in the direction moving away from the center O of the pass line), as shown in FIG. 5D, in the grooved rolls R21B to R23B in an initial state (state shown in FIG. 5A). At this time, the grooved roll R22B is opened to a position at which the flange portion of the grooved roll R21B does not come into contact with the flange portion of the grooved roll R22B, at a time of closing the grooved roll R21B in the pressing direction (coming to a state shown in FIG. 5E) as mentioned below. Further, the grooved roll R23B is opened to a position at which the grooved roll R21B does not interfere with the grooved roll R23B, at a time of closing the grooved roll R21B in the pressing direction (coming to the state shown in FIG. 5E) as mentioned below.

Next, as shown in FIG. 5E, after the grooved roll R21B is closed more in the pressing direction than a position shown in FIG. 5H (is moved in such a manner as to come close to the center O of the pass line), the grooved roll R22B is closed in the pressing direction until the flange portion of the grooved roll R22B comes into contact with the side surface of the grooved roll R21B under certain load. At this time, since the side surface of the grooved roll R21B extends in parallel to the pressing direction of the grooved roll R21B, a position at which the flange portion of the grooved roll R22B comes into contact with the side surface of the grooved roll R21B (position in the pressing direction (Y2 direction in FIG. 5E) of the grooved roll R22B) is fixed regardless of a closing amount (moving amount from a position shown in FIG. 5H) of the grooved roll R21B. Accordingly, it is possible to decide the reference position in the pressing direction of the grooved roll R22B in accordance with the procedure mentioned above.

Finally, in order to decide the reference position in the pressing direction of the grooved roll R23B, each of the grooved rolls R21B and R23B is opened in the pressing direction (is moved in the direction moving away from the center O of the pass line), as shown in FIG. 5F, in the grooved rolls R21B to R23B in an initial state (state shown in FIG. 5A). At this time, the grooved roll R23B is opened to a position at which the flange portion of the grooved roll R22B does not come into contact with the flange portion of the grooved roll R23B, at a time of closing the grooved roll R22B in the pressing direction (coming to a state shown in FIG. 5G) as mentioned below. Further, the grooved roll R21B is opened to a position at which the grooved roll R22B does not interfere with the grooved roll R21B, at a time of closing the grooved roll R22B in the pressing direction (coming to a state shown in FIG. 5G) as mentioned below.

Next, as shown in FIG. 5G, after the grooved roll R22B is closed more in the pressing direction than a position shown in FIG. 5H (is moved in such a manner as to come close to the center O of the pass line), the grooved roll R23B is closed in the pressing direction until the flange portion of the grooved roll R23B comes into contact with the side surface of the grooved roll R22B under certain load. At this time, since the side surface of the grooved roll R22B extends in parallel to the pressing direction of the grooved roll R22B, a position at which the flange portion of the grooved roll R23B comes into contact with the side surface of the grooved roll R22B (position in the pressing direction (Y3 direction in FIG. 5G) of the grooved roll R23B) is fixed regardless of a closing amount (moving amount from a position shown in FIG. 5H) of the grooved roll R22B. Accordingly, it is possible to decide the reference position in the pressing direction of the grooved roll R23B, in accordance with the procedure mentioned above.

It is possible to decide the reference position at least in the pressing direction of the grooved rolls R21B to R23B in accordance with the procedure described above. Further, in each of the grooved rolls R21B to R23B, it is possible to carry out the calibration of the pressing position based on the information of the reference position, and to suppress the thickness deviation of the material to be rolled. In this case, if the grooved rolls R21B to R23B are integrally moved by moving the housing in such a manner that the position of center of gravity of the grooved rolls R21B to R23B existing at the reference position comes into line with the center O of the pass line, the calibration of the pressing position can be carried out based on the center O of the pass line.

In the present embodiment, the description is given of the example in which all of three grooved rolls R21B, R22B and R23B can be closed more in the pressing direction than the position shown in FIG. 5H. Further, the description is given of the example in which the reference position in the pressing direction of the grooved roll R21B is decided by closing the grooved roll R23B more in the pressing direction than the position shown in FIG. 5H, the reference position in the pressing direction of the grooved roll R22B is decided by closing the grooved roll R21B more in the pressing direction than the position shown in FIG. 5H, and the reference position in the pressing direction of the grooved roll R23B is decided by closing the grooved roll R22B more in the pressing direction than the position shown in FIG. 5H. However, the present invention is not limited thereto, but at least any two grooved rolls may be closed more in the pressing direction than the position shown in FIG. 5H. For example, two grooved rolls R22B and R23B may be closed more in the pressing direction than the position shown in FIG. 5H. In this case, at first, the grooved roll R23B is closed more in the pressing direction than the position shown in FIG. 5H. Next, the flange portion of the grooved roll R21B is brought into contact with one side surface of the grooved roll R23B, and the flange portion of the grooved roll R22B is brought into contact with the other side surface of the grooved roll R23B. In accordance with the procedure described above, it is possible to decide the reference position in the pressing direction of the grooved rolls R21B and R22B. Further, it is possible to decide the reference position in the pressing direction of the grooved roll R23B by closing the grooved roll R22B more in the pressing direction than the position shown in FIG. 5H, and bringing the flange portion of the grooved roll R23B into contact with the side surface of the grooved roll R22B in the same manner as mentioned above. In this manner, if at least any two grooved rolls can be closed more in the pressing direction than the position shown in FIG. 5H, it is possible to decide the reference position in the pressing direction, with regard to all of three grooved rolls R21B to R23B.

Third Embodiment

Figure 6:
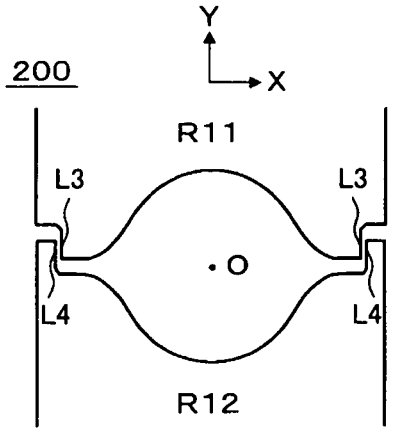
FIG. 6 is a vertical cross sectional view showing an outline structure of a rolling stand constructing a 2-roll type mandrel mill in accordance with a third embodiment of the present invention.

FIG. 6 is a vertical cross sectional view showing an outline structure of a rolling stand constructing a 2-roll type mandrel mill in accordance with a third embodiment of the present invention. As shown in FIG. 6, a rolling stand 200 in accordance with the present embodiment is provided with a housing (not shown), and two grooved rolls R11 and R12 arranged in the housing and opposing to each other.

The following feature is provided in a vertical cross sectional shape of the grooved rolls R11 and R12 (cross sectional shape formed by cutting in a plane which includes center lines of rotating axes of the grooved rolls R11 and R12 and is orthogonal to a pass line of a material to be rolled (reference symbol O in FIG. 6 denotes a center of the pass line of the material to be rolled)) provided in the rolling stand 200 in accordance with the present embodiment. In other words, one grooved roll R11 is provided with a third straight portion L3 extending in parallel to a pressing direction (Y direction in FIG. 6) in at least one side flange portion (both side flange portions in the present embodiment). Further, the other grooved roll R12 is provided with a fourth straight portion L4 opposing to the third straight portion L3 and extending in parallel to the third straight portion L3 in a flange portion.

In the rolling stand 200 having the structure mentioned above, a reference position is decided for regulating the pressing positions of the grooved rolls R11 and R12, for example, in accordance with the following procedure.

A reference position in the Y direction is decided by closing the grooved rolls R11 and R12 in the pressing direction (moving in such a manner as to come close to the center O of the pass line) and bringing the flange portions into contact with each other under certain load, in the same manner as the conventional one.

On the other hand, a reference position in a direction (X direction in FIG. 6) which is vertical to the pressing direction is decided by moving the grooved roll R11 or R12 in the X direction until the third straight portion L3 of the grooved roll R11 comes into contact with the fourth straight portion L4 of the grooved roll R12 under certain load. In the present embodiment, since the third straight portion L3 is provided in both side flange portions of the grooved roll R11, the reference position in the X direction of the grooved roll R11 or R12 can be decided by bringing any one third straight portion L3 into contact with the fourth straight portion L 4 opposing thereto, or by making an interval of the third straight portions L3 approximately equal to an interval of the fourth straight portions L4, and fitting the third straight portion L 3 between the fourth straight portions L4. In this case, the decision of the reference position in the X direction of the grooved roll R11 or R12 can be achieved by attaching a driving mechanism (cylinder apparatus or the like) moving forward and backward in the X direction to the grooved roll R11 or R12, however, can be achieved by attaching the driving mechanisms moving forward and backward in the Y direction to both sides in the direction of the rotating axis of the grooved roll R11 or R12 and differentiating the amount of forward and backward movement of both the driving mechanisms in the same manner as the technique described in Japanese Unexamined Patent Publication No. 2003-220403 (in the latter case, the grooved roll R11 or R12 moves in the X direction at the same time of the Y direction).

In accordance with the procedure described above, it is possible to decide the reference positions in the X direction and the Y direction of the grooved rolls R11 and R12. Further, in each of the grooved rolls R11 and R12, it is possible to carry out the calibration of the pressing position based on the information of the reference position, and to suppress the thickness deviation of the material to be rolled. In this case, if the grooved rolls R11 and R12 are integrally moved by moving the housing in such a manner that the position of center of gravity of the grooved rolls R11 and R12 existing at the reference positions comes into line with the center of the pass line, the calibration of the pressing position can be achieved based on the center O of the pass line.

Fourth Embodiment

FIGS. 7A to 7E are vertical cross sectional views showing an outline structure of a rolling stand constructing a 4-roll type mandrel mill in accordance with a fourth embodiment of the present invention and an example of a deciding procedure of a reference position for regulating a pressing position. As shown in FIGS. 7A to 7E, a rolling stand 300 in accordance with the present embodiment is provided with a housing (not shown), and four grooved rolls R31, R32, R33 and R34 arranged in the housing in such a manner that an angle formed by pressing directions of any two adjacent grooved rolls of the four grooved rolls R31, R32, R33 and R34 comes to 90 degrees.

The following feature is provided in a vertical cross sectional shape of the grooved rolls R31, R32, R33 and R34 (cross sectional shape formed by cutting in a plane which includes center lines of rotating axes of the grooved rolls R31, R32, R33 and R34 and is orthogonal to a pass line of a material to be rolled (reference symbol O in FIGS. 7C and 7E denotes a center of the pass line of the material to be rolled)) provided in the rolling stand 300 in accordance with the present embodiment. In other words, in any one set of grooved rolls R31 and R33 opposing to each other, at least one grooved roll (both grooved rolls in the present embodiment) is provided with a first straight portion L1 extending vertically to a pressing direction (Y direction in FIG. 7A) in both side flange portions, and is provided with a third straight portion L3 extending in parallel to the pressing direction in both side flange portions. Further, in the other set of grooved rolls R32 and R34, both the grooved rolls R32 and R34 are provided with a second straight portion L2 opposing to the first straight portion L1 and extending in parallel to the first straight portion L1 in a flange portion (both side flange portions in the present embodiment), and is provided with a fourth straight portion L4 opposing to the third straight portion L3 and extending in parallel to the third straight portion L3 in a flange portion (both side flange portions in the present embodiment).

In the rolling stand 300 having the structure mentioned above, the reference position is decided for regulating the pressing positions of the grooved rolls R31, R32, R33 and R34, for example, in accordance with the following procedure.

Figure 7A:
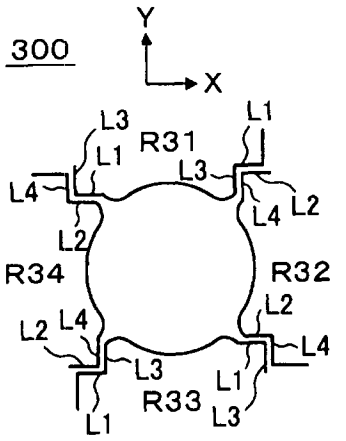
FIGS. 7A to 7E are vertical cross sectional views showing an outline structure of a rolling stand constructing a 4-roll type mandrel mill in accordance with a fourth embodiment of the present invention and an example of a deciding procedure of a reference position for regulating a pressing position.
Figure 7B:
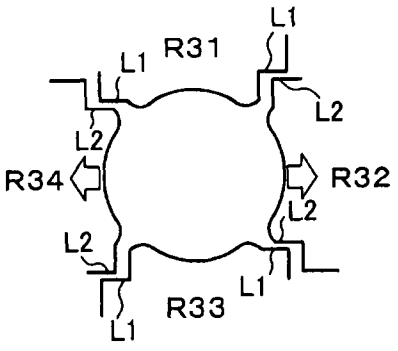
Figure 7C:
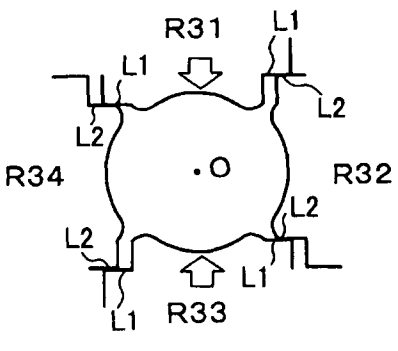

First, in the grooved rolls R31 to R34 in an initial state (state shown in FIG. 7A), each of the grooved rolls R32 and R34 provided with the second straight portion L2 and the fourth straight portion L4 is opened in the pressing direction (is moved in a direction coming away from the center of the pass line), as shown in FIG. 7B. At this time, the grooved rolls R32 and R34 are opened in such a manner as to hold a state in which the first straight portion L1 and the second straight portion L2 oppose to each other (state having an overlapping portion as seen in the Y direction). Next, as shown in FIG. 7C, each of the grooved rolls R31 and R33 is closed in the pressing direction until the first straight portions L1 of the grooved rolls R31 and R33 come into contact with the second straight portions L2 of the grooved rolls R32 and R34 under certain load (is moved in such a manner as to come close to the center of the pass line). At this time, the contact between the first straight portion L1 and the second straight portion L2 is not obstructed, since, as mentioned above, the grooved rolls R32 and R34 are previously set to a state of being open in the pressing direction, and the remaining positions of the flange portions of the grooved rolls R31 to R34 do not come into contact with each other.

It is possible to decide the reference position in the Y direction of the grooved rolls R31 to R34 in accordance with the procedure described above.

Figure 7D:
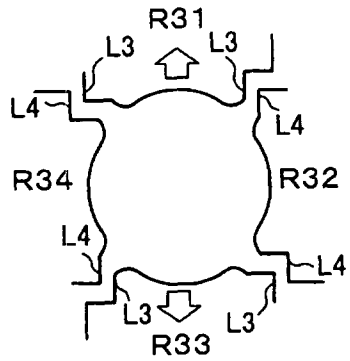
Figure 7E:
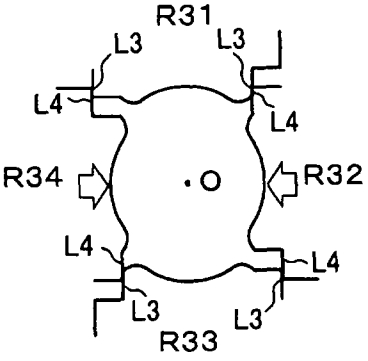

Next, as shown in FIG. 7D, each of the grooved rolls R31 and R33 provided with the first straight portion L1 and the third straight portion L3 is evenly opened in the pressing direction (is moved in the direction moving away from the center O of the pass line). At this time, the grooved rolls R31 and R33 are opened in such a manner as to hold a state in which the third straight portion L3 and the fourth straight portion L4 oppose to each other (state having an overlapping portion as seen in the X direction). Next, as shown in FIG. 7E, each of the grooved rolls R32 and R34 is closed in the pressing direction (is moved in such a manner as to come close to the center O of the pass line) until the fourth straight portions L4 of the grooved rolls R32 and R34 come into contact with the third straight portions L3 of the grooved rolls R31 and R33 under certain load. At this time, as mentioned above, since the grooved rolls R31 and R33 are previously set to the state of being open in the pressing direction, and the other positions of the flange portions of the grooved rolls R31 to R34 do not come into contact with each other, the contact between the third straight portion L3 and the fourth straight portion L4 is not obstructed.

In accordance with the procedure described above, it is possible to decide the reference position in the X direction, in addition to the decision of the reference position in the Y direction of the grooved rolls R31 to R34 mentioned above. Further, in each of the grooved rolls R31 to R34, it is possible to carry out the calibration of the pressing position based on the information of the reference position, and to suppress the thickness deviation of the material to be rolled. In this case, if the grooved rolls R31 to R34 are integrally moved by moving the housing in such a manner that the position of center of gravity of each of the grooved rolls R31 to R34 existing at the position evenly moved in the pressing direction from the reference positions in the X direction and the Y direction comes into line with the center O of the pass line, the calibration of the pressing position can be achieved based on the center O of the pass line.

The invention claimed is:

1. A rolling stand comprising three grooved rolls, wherein the three grooved rolls are arranged around a pass line center of a material to be rolled, each of the grooved rolls movable in a direction towards and away from the pass line center, wherein with regard to a cross sectional shape of each of the grooved rolls, the cross sectional shape of any one grooved roll is provided with a first straight portion extending vertically to the pressing direction in both side flange portions of the any one grooved roll, and wherein the cross sectional shape of the other two grooved rolls is provided with a second straight portion opposing to the first straight portion and extending in parallel to the first straight portion in flange portions of the other two grooved rolls.

2. The rolling stand as claimed in claim 1, wherein the cross sectional shape of the any one grooved roll provided with the first straight portion is further provided with a third straight portion extending in parallel to the movable direction in at least one side flange portion of the any one grooved roll, and wherein the cross sectional shape of at least one grooved roll in the other two grooved rolls provided with the second straight portions is further provided with a fourth straight portion opposing to the third straight portion and extending in parallel to the third straight portion in a flange portion of the at least one grooved roll.

3. A rolling stand comprising four grooved rolls, wherein the four grooved rolls are arranged around a pass line center of a material to be rolled, each of the grooved rolls movable in a direction towards and away from the pass line center, wherein with regard to a cross sectional shape of each of the grooved rolls, the cross sectional shape of at least one grooved roll in any one set of opposing grooved rolls is provided with a first straight portion extending vertically to the movable direction in both side flange portions of the at least one grooved roll, and is provided with a third straight portion extending in parallel to the movable direction in the both side flange portions of the at least one grooved roll, and wherein the cross sectional shape of each of the grooved rolls in the other set of grooved rolls is provided with a second straight portion opposing to the first straight portion and extending in parallel to the first straight portion in a flange portion of each of the grooved rolls in the other set of grooved rolls, and is provided with a fourth straight portion opposing to the third straight portion and extending in parallel to the third straight portion in the flange portion of each of the grooved rolls in the other set of grooved rolls.

* * * * *